United States Patent [19]

Ryder, Jr. et al.

[11] Patent Number: 4,922,847

[45] Date of Patent: May 8, 1990

[54] PLIANT ANCHORING DEVICE FOR USE WITH DISPOSABLE BALLAST

[76] Inventors: R. James Ryder, Jr., 67645 Dailey Rd., Edwardsburg, Mich. 49112; D. Michael Barton, 70830 Driftwood Dr., Edwardsburg, Mich. 49112

[21] Appl. No.: 348,359

[22] Filed: May 8, 1989

[51] Int. Cl.[5] ..... G01V 1/38

[52] U.S. Cl. ..... 114/299; 114/297; 383/16

[58] Field of Search ..... 383/902, 117, 16; 43/7, 43/8; 114/293, 294, 297–299, 210, 310, 311

[56] References Cited

U.S. PATENT DOCUMENTS

| | | | |
|---|---|---|---|
| 513,855 | 1/1894 | Zertuche | 114/311 |
| 578,562 | 3/1897 | Hart | 114/311 |
| 1,012,890 | 12/1911 | Miller | 114/311 |
| 1,133,154 | 3/1915 | Kahnweiler | 114/311 |
| 1,148,924 | 8/1915 | Paradise | 114/294 |
| 1,731,785 | 10/1979 | Mansell | 114/294 |
| 2,491,564 | 12/1949 | Iversen | 114/311 |
| 2,536,682 | 1/1951 | Frieder | 114/311 |
| 3,064,613 | 11/1962 | Hubick | 114/311 |
| 3,322,176 | 5/1967 | Geller | 383/16 |
| 4,632,051 | 12/1986 | Raymond | 114/311 |

FOREIGN PATENT DOCUMENTS

| | | | |
|---|---|---|---|
| 2592624 | 6/1987 | France | 114/299 |
| 58-214488 | 12/1983 | Japan | 114/294 |

*Primary Examiner*—Joseph F. Peters, Jr.
*Assistant Examiner*—Clifford T. Bartz
*Attorney, Agent, or Firm*—Wendell E. Miller

[57] ABSTRACT

A pliant anchoring device (10) includes a pliant anchor (12) having a pliant pouch (14) and a pliant extension (16), a first rope (24) that is attached to a first attaching point (18), and a second rope (26) that is attached to a second attaching point (28). In use, disposable ballast (40) is placed in the anchor (12), and the anchor (12) is secured to a boat and lowered to the bottom (50) of a body of water. To retrieve the anchor (12), a tension force is put on the second rope (26) thereby repositioning the anchor (12) from a ballast-retaining position (54) to a ballast-dumping position (56), the ballast (40) is dumped from the anchor (12), and the anchor (12) is retrieved from the body of water.

25 Claims, 1 Drawing Sheet

PLIANT ANCHORING DEVICE FOR USE WITH DISPOSABLE BALLAST

BACKGROUND OF THE INVENTION

Often, fishermen find it necessary to use one or more anchors when fishing from row boats, or from small boats using outboard motors. Sometimes fishermen troll through a body of water. However, schools of fish tend to remain in generally localized regions that provide secure hiding places and/or adequate food. Obviously, it is advantageous to anchor where the fish are located, rather than trolling over an extensive area.

Rocky bottoms provide excellent hiding places for fish and/or for the food they eat. Sometimes these rocky bottoms consist of natural rocks; but often they consist of broken pieces of concrete that have been dumped to provide a breakwater.

Conventional anchors often become so firmly caught in rocks, or broken pieces of concrete, that it is impossible to free them, and so it becomes necessary to cut the boat free from the anchor.

The cost of replacing conventional anchors that are irretrievably lost in rocky bottoms is a financial burden to fishermen who own their own boats and anchors.

However, the problem is more severe in resort areas where a large percentage of the boats are rental boats. Because of the frequent loss of conventional anchors and the high cost of replacement, many who rent boats will not rent anchors with their boats. Then, the cost of owning an anchor, and the burden of transporting it along with all of his fishing gear, is placed on the fisherman.

If the fisherman is without his own anchor, loses his own anchor, or is unable to rent an anchor, then he must drift or troll an area that is greater than an area in which he finds fish. Therefore his total catch is reduced, and he loses much of the pleasure of an expensive vacation or outing.

FIELD OF THE INVENTION

The present invention relates to a device for anchoring small boats. More particularly, the present invention relates to an anchoring device for anchoring small boats by the use of disposable ballast, and dumping the disposable ballast before retrieving the anchoring device.

DESCRIPTION OF THE RELATED ART

A partial answer to the problem of losing boat anchors in rocky bottoms has been provided by Paradise in U.S. Pat. No. 1,148,924. Paradise teaches the use of an anchoring device that utilizes disposable ballast. A cloth bag is equipped with a drawstring to close the top thereof, disposable ballast, such as rocks, is inserted into the bag prior to the closing thereof, and the anchoring device is utilized for anchoring small boats such as are used for fishermen.

The prior art also includes a second anchoring device for use with disposable ballast. This prior art device was advertised in the July 1947 issue of *Scientific American.* The anchoring device in this advertisement consisted of a mesh net made of sisal rope, and was said to be able to contain twenty-five pounds of stone.

While these two prior art anchoring devices provided economical and easily transportable anchors, they did not completely solve the problem of losing the anchors in rocky bottoms.

SUMMARY OF THE INVENTION

In the present invention, a pliant anchoring device is provided for anchoring boats by the use of disposable ballast. The anchoring device includes a pliant container which is positionable to ballast-retaining and ballast-dumping positions, a first rope that is attached to the pliant container in a location in which a load applied to the first rope is effective to position the pliant container to the ballast-retaining position thereof, and a second rope that is attached to the pliant container in a location in which a force applied to the second rope is effective to position the pliant container to the ballast-dumping position thereof.

In a preferred configuration, the pliant container consists of a mesh bag that is made of a flexible cord.

It is a primary object of the present invention to provide an anchoring device in which there is a reduced risk of the anchor becoming irretrievably lost in rocky bottoms.

It is an object of the present invention to provide an anchoring device that utilizes disposable ballast and that includes means for dumping the disposable ballast before raising the anchoring device.

It is an object of the present invention to provide an anchoring device that is economical, low in weight, easily transportable, easily storable, and that utilizes disposable ballast.

Other objects of the invention will become obvious from the drawings and detailed description that are included herein.

DESCRIPTION OF THE PREFERRED EMBODIMENTS

Figure 1:
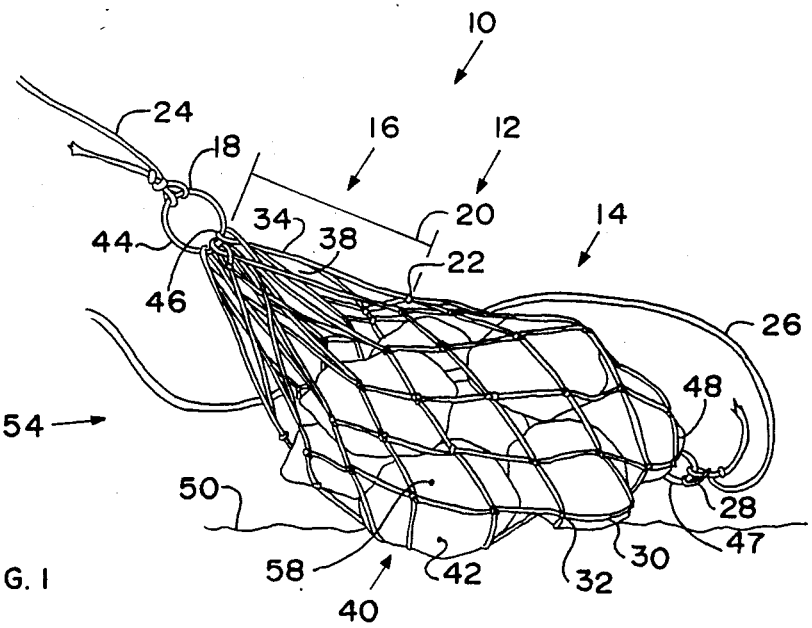
FIG. 1 is a side elevation of the anchoring device with the pliant container in the ballast-retaining position, and with a plurality of rocks in the pliant container.

Referring now to the drawings, a pliant anchoring device, or foldable anchoring device, 10 includes a ballast anchor 12 which is also referred to herein as a pliant anchor. The ballast anchor 12 includes a pliant receptacle, or pliant container portion, 14 and a pliant extension 16 that is operatively attached to the receptacle 14. The pliant receptacle 14 is also referred to herein as a pliant pouch or net pouch.

The pliant extension 16 provides means for spacing a first attaching point, or first location, 18 at a spaced-apart distance 20 from a top opening 22 of the pliant pouch 14.

A first rope, or boat-anchoring rope, 24 is attached to the first attaching point 18, and a second rope 26 is attached to a second attaching point, or second location, 28. The second attaching point 28 is located distal from both the first attaching point 18 and the top opening 22 of the pliant pouch 14.

Both the pliant pouch 14 and the pliant extension 16 are made of cord 30. The pliant pouch 14 is fabricated by knot-tying the cord 30 with knots 32; so the pliant pouch 14 may be called a knot-tied pouch. The pliant extension 16 consists of a plurality of pliant tension members 34 which are also referred to herein as portions 34 of the cord 30.

The pliant anchor 12 includes a plurality of elongated openings, or spaces, 38 which consists of spaces between adjacent ones of the pliant tension members 34. The elongated openings 38 provide means for placing disposable ballast 40 into the pliant anchor 12, and also provide means for dumping ballast 40 from the pliant anchor 12. Since the entire anchor 12, including the tension members 34, is made of pliant material, the elongated openings 38 will widen, or otherwise change their shape, to conform to the individual shape of pieces 42 of ballast 40 being placed into the anchor 12, or being dumped from the anchor 12.

Preferably, the pliant pouch 14 and the pliant extension 16 consist of a continuous single strand of the cord 30; and preferably the cord 30 is of a material, such as nylon or polyester, that will not rot or mildew.

The first attaching point 18, as shown herein, includes a metal ring 44 that retainably engages first looped strands 46 of the cord 30. The first looped strands 46 include the portions 34 of the cord 30 that form the pliant extension 16; and the second attaching point 28, as shown herein, includes a second metal ring 47 and knotted strands 48 of the cord 30 that form the pliant pouch 14.

In use, the pliant anchor 12 is folded, or otherwise collapsed or compressed, and then stored in the fisherman's tackle box, not shown, not a part of the invention, or in his pocket, or in any other suitable place.

The method includes unfolding the pliant anchor 12, attaching the first rope 24 to the first attaching point 18, attaching the second rope 26 to the second attaching point 28, expanding the pliant anchor 12, placing disposable ballast 40, consisting of individual pieces 42 of rock or other heavy and inexpensive material, into the pliant pouch 14 by inserting them through openings 38 between adjacent ones of the pliant tension members 34, flexibly securing the pliant anchor 12 to a boat, not shown, lowering the pliant anchor 12 to a bottom, or bottom surface, 50 below a body of water by applying a tension load to the first rope 24, dumping the ballast 40 from the pliant container 12 by inverting, or partially inverting, the pliant anchor 12 from a ballast-retaining position 54 to a ballast-dumping position, or ballast-releasing position, 56 by means of applying a force to the second rope 26, raising, or retrieving, the pliant anchor 12 subsequent to the dumping step, collapsing the pliant anchor 12, and folding the pliant anchor 12.

In summary, the present invention provides an inexpensive and easily storable anchor which uses disposable ballast, and which includes means for dumping the disposable ballast before raising, or retrieving the anchor.

Figure 2:
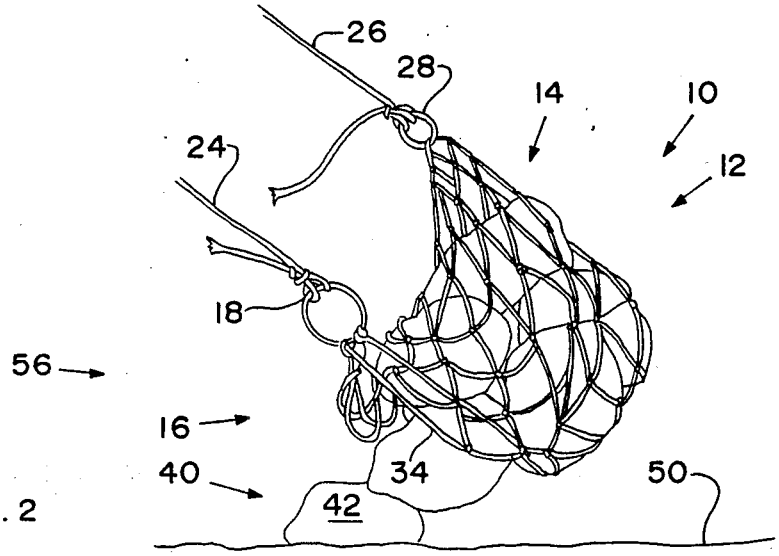
FIG. 2 is a side elevation of the anchoring device with the pliant container in the ballast-dumping position thereof, and with the rocks being discharged from the pliant container.

The means for dumping the ballast 40 includes the second rope 26 and the ballast-dumping position 56 of the ballast anchor 12. As can be seen in FIG. 2, the ballast anchor 12 can be repositioned to the ballast-dumping position 56 even with the second rope 26 being tensioned generally parallel to the boat-anchoring rope 24. That is, the ballast 40 can be dumped by placing a force on the ballast anchor 12 that is in the same direction as the anchoring load of the boat that is placed on the boat-anchoring rope 24.

The present invention provides an anchor which conforms itself to the bottom of a body of water, and which includes diamond-shaped opoenings 58 that provide good anchoring characteristics on mud or sand bottoms, and which includes knots 32 which further increase the anchoring characteristics, particularly on mud or sand bottoms.

Conventional anchors are direction sensitive, in that they include gripping features at diametrically opposite locations, whereas the present invention provides equal gripping characteristics for any rotational orientation of the pliant anchor 12.

Conventional anchors are rigid, and release of conventional anchors requires a space between rocks that will clear the physical dimensions of the anchor, whereas the ballast 40 of the pliant anchor 12 allows the pliant anchor 12 to change its shape, and/or to dump its ballast, to permit passage through various sizes and shapes of openings.

Conventional anchors are direction-sensitive with regard to the release force, whereas the anchoring device 10 of the present invention can be released from any direction, or at the direction that facilitates removal from entrapping material.

Finally, conventional anchoring devices are dislodged from anchoring grip of the bottom by placing a tension force on the anchoring rope, whereas the anchoring device 10 of the present invention is dislodged by applying a tension force on a second rope, greatly facilitating dislodging of the anchor from a rocky bottom, particularly if the rocks are broken pieces of concrete.

While a specific ballast-dumping position has been illustrated in FIG. 2, it will be realized that actual ballast-dumping positions 56 will vary with variations in such factors as: partially inverting the pliant anchor 12 in accordance with the ratio between the length of the boat-anchoring rope 24 and the depth of the body of water, the material of the bottom surface 50, and/or completely inverting the ballast anchor 12 by lifting it from the bottom surface 50 by the second rope 26. Further, while a specific ballast-retaining position has been illustrated in FIG. 1, it will be realized that actual ballast-retaining positions 54 will vary from suspending the ballast anchor 12 by the first rope 24 to various ratios between the length of the boat-anchoring rope 24 and the depth of the body of water.

Therefore, for purposes of interpreting the claims, any position in which the ballast is dumped is a ballast-dumping position 56, and any position in which the ballast is retained is a ballast-retaining position 54.

While specific apparatus and method have been disclosed in the preceding description, and while part numbers have been inserted parenthetically into the claims to facilitate understanding of the claims, it should be understood that these specifics have been given for the purpose of disclosing the principles of the present invention and that many variations thereof will become apparent to those who are versed in the art. Therefore, the scope of the present invention is to be determined by the appended claims, and without any limitation by the part numbers inserted parenthetically in the claims.

Industrial Applicability

The present invention is applicable to anchoring boats, especially small fishing boats, in bodies of water in which the bottom surface is mud, sand, rock, or broken pieces or concrete, and in bodies of water in which anchors are easily lost by entanglement with limbs, broken pieces of concrete, structural steel, or scrap metal.

What is claimed is:

1. An anchoring device (10) for boats, which anchoring device comprises:

ballast anchor means (12) for releasably receiving disposable ballast (40);

means, comprising a rope (24), for attaching said ballast anchor means to a boat; and means (26) for partial inversion of said ballast anchor means to dump said ballast from said ballast anchor means without the necessity of retrieving said ballast anchor means.

2. An anchoring device (10) as claimed in claim 1 in which said ballast anchor means (12) includes a container portion (14) with a top opening (22);

said means for attaching said ballast anchor means to said boat comprises extension means (16), being operatively connected to said container portion proximal to said top opening, said extension means attaching said rope (24) at a spaced-apart distance (20) from said top opening.

3. An anchoring device (10) as claimed in claim 1 in which said means for dumping said ballast (40) comprises a second rope (26) that is operatively attached to said ballast anchor means (12).

4. An anchoring device (10) as claimed in claim 1 in which said ballast anchor means (12) includes a container portion (14) with a top opening (22);

said means for attaching said ballast anchor means to said boat comprises extension means (16), including tension members (34), for attaching said rope (24) at a spaced-apart distance (20) from said top opening; and said means for dumping said ballast (40) comprises a second opening (38) that is disposed between said tension members, and a second rope (26) that is operatively attached to said container portion distal from said top opening.

5. An anchoring device (10) as claimed in claim 1 in which said ballast anchor means (12) includes a container portion (12) with a top opening (22);

said means for attaching said ballast anchor means to said boat comprises extension means (16) for attaching said rope (24) at a spaced-apart distance (20) from said top opening; and said means for dumping said ballast comprises a second rope (26) that is operatively attached to said container portion distal from said top opening.

6. An anchoring device (10) as claimed in claim 2 in which said extension means (16) comprises tension members (34); and said means for dumping said ballast comprises a space (38) between said tension members.

7. A foldable anchoring device (10) for anchoring boats to a surface (50) below the water by the use of disposable ballast (40), which anchoring device comprises:

pliant anchor means (12) for releasably receiving ballast (40);

means, comprising a first rope (24) that is operatively attached to said pliant anchor means, for anchoring a boat to said pliant anchor means; and means, comprising a second rope (26) that is operatively attached to said pliant anchor means, for dumping said ballast from said pliant anchor means without the necessity of retrieving said pliant anchor means.

8. An anchoring device (10) as claimed in claim 7 in which said pliant anchor means (12) includes a pliant pouch (14) and a pliant extension (16); and said attaching of said first rope (24) to said pliant anchor means comprises attaching said first rope to said pliant extension.

9. An anchoring device (10) as claimed in claim 8 in which said operative attachment of said second rope (26) to said pliant anchor means (12) comprises attachment of said second rope to said pliant pouch (14).

10. An anchoring device (10) as claimed in claim 7 in which said means for dumping said ballast (40) from said pliant anchor means (12) comprises an opening (38) in said pliant anchor means.

11. An anchoring device (10) as claimed in claim 7 in which said pliant anchor means (12) includes a pliant pouch (14) and a pliant extension (16);

said attaching of said first rope (24) to said pliant anchor means comprises attaching said first rope to said pliant extension; and said means for dumping said ballast (40) from said pliant anchor means comprises an opening (38) in said pliant extension.

12. An anchoring device (10) as claimed in claim 7 in which said pliant anchor means (12) includes a net pouch (14), and a plurality of pliant tension members (34) that are operatively attached to said net pouch;

said attaching of said first rope (24) to said pliant anchor means comprises attaching said first rope to said pliant tension members; and said means for dumping said ballast (40) from said pliant anchor means comprises an opening (38) between two of said pliant tension members.

13. An anchoring device (10) as claimed in claim 12 in which said net pouch (14) comprises knot-tied cord (30); and said pliant tension members comprise portions (34) of cord (30) that are operatively attached to said net pouch.

14. An anchoring device (10) as claimed in claim 12 in which said operative attachment of said second rope (26) to said pliant anchor means comprises attachment of said second rope to said net pouch (14) distal from said pliant tension members (34).

15. An anchoring device (10) as claimed in claim 12 in which said net pouch (14) comprises knot-tied cord (30);

said pliant tension members comprise portions (36) of cord (30) that are operatively attached to said net pouch; and said operative attachment of said second rope (26) to said pliant anchor means (12) comprises operative attachment of said second rope to said net pouch distal from said pliant tension members.

16. A method of releasably anchoring a boat to the bottom (50) of a body of water, which method comprises:

(a) expanding a pliant anchor (12);

(b) placing disposable ballast (40) in said pliant anchor;

(c) flexibly securing said pliant anchor to said boat;

(d) lowering said pliant anchor to said bottom;

(e) dumping said ballast from said pliant anchor;

(f) retrieving said pliant anchor subsequent to said dumping step; and (g) collapsing said pliant anchor subsequent to said retrieving step.

17. A method as claimed in claim 16 in which said dumping step comprises repositioning said pliant anchor (12) from a ballast-retaining position (54) to a ballast-dumping position (56).

18. A method as claimed in claim 16 in which said method comprises attaching a rope (26) to said pliant anchor (12) prior to said lowering step; and said dumping step comprises placing a tension force on said rope.

19. A method as claimed in claim 16 in which said dumping step comprises repositioning said pliant anchor from a ballast-retaining position (54) to a ballast-releasing position (56).

20. A method of releasably anchoring a boat to the bottom (50) of a body of water, which method comprises:

(a) unfolding a pliant container (12);

(b) placing disposable battast (40) into said pliant container;

(c) flexibly securing said pliant container to said boat;

(d) lowering said pliant container to said bottom;

(e) dumping said ballast from said pliant container;

(f) raising said pliant container subsequent to said dumping step; and (g) folding said pliant container.

21. A method as claimed in claim 20 in which said lowering step comprises placing a tension load on said pliant container at a first location (18); and said dumping step comprises placing a tension force on said pliant container at a second location (28).

22. A method as claimed in claim 20 in which said dumping step comprises:

(a) positioning said ballast against an elongated opening (38);

(b) widening said opening; and (c) discharging said ballast through said opening.

23. A method as claimed in claim 20 in which said dumping step comprises widening an elongated opening (38) in said pliant container.

24. A method as claimed in claim 20 in which said dumping step comprises repositioning said pliant container from a ballast-retaining position (54) to a ballast-dumping position (56).

25. A method as claimed in claim 23 in which said widening step comprises positioning said ballast against said elongated opening.

* * * * *

UNITED STATES PATENT AND TRADEMARK OFFICE

CERTIFICATE OF CORRECTION

PATENT NO. : 4,922,847

DATED : May 8, 1990

INVENTOR(S) : R. James Ryder Jr. et al.

It is certified that error appears in the above-identified patent and that said Letters Patent is hereby corrected as shown below:

In column 3, "opoenings" should be --openings-- in line 67. In column 4, "or" should be --of-- in line 64. In column 7, "battast" should be --ballast-- in line 15.

Signed and Sealed this

Fourth Day of February, 1992

*Attest:*

HARRY F. MANBECK, JR.

*Attesting Officer*

*Commissioner of Patents and Trademarks*